US005090943A

United States Patent [19]

Greig et al.

[11] Patent Number: 5,090,943

[45] Date of Patent: Feb. 25, 1992

[54] DOCUMENT CARRIER

[75] Inventors: Walter G. Greig, Lewiston, N.Y.; Robert E. Ashby, Quakertown, Pa.

[73] Assignee: Moore Business Forms, Inc., Grand Island, N.Y.

[21] Appl. No.: 583,978

[22] Filed: Sep. 18, 1990

[51] Int. Cl.[5] ..... B41L 3/00

[52] U.S. Cl. ..... 462/71; 462/84

[58] Field of Search ..... 283/81; 462/71, 84

[56] References Cited

U.S. PATENT DOCUMENTS

| | | | |
|---|---|---|---|
| 2,535,798 | 12/1950 | Johnston | 462/84 X |
| 3,283,434 | 11/1966 | Gurin et al. | 40/158 |
| 3,581,423 | 6/1971 | Mascolo | 40/158 B |
| 3,736,685 | 6/1973 | Shibata | 40/158 |
| 3,857,192 | 12/1974 | Mascolo | 40/158 R |
| 4,077,830 | 3/1978 | Fulwiler | 156/249 |
| 4,121,856 | 10/1978 | Brunette | 283/81 X |
| 4,121,961 | 10/1978 | Brunette et al. | 283/81 X |
| 4,156,978 | 6/1979 | Swift etal. | 40/158 B |
| 4,277,089 | 7/1981 | Lockhart | 283/81 X |
| 4,645,239 | 2/1987 | Adams | 283/81 X |
| 4,941,685 | 7/1990 | Anderson | 462/84 X |

FOREIGN PATENT DOCUMENTS

| | | |
|---|---|---|
| 1177355 | 11/1984 | Canada . |
| 2229082 | 12/1974 | France . |

*Primary Examiner*—Paul A. Bell

*Attorney, Agent, or Firm*—Nixon & Vanderhye

[57] ABSTRACT

A document carrier assembly for processing a plurality of documents through a microfilming machine is provided which includes a web of paper having an upper and lower surface, at least the upper surface having a low tack adhesive layer applied thereon; a liner overlying the upper surface of the web and the low tack adhesive layer, the liner having a self-contained carbonless coating on an upper surface thereof; and a clear plastic film overlying the liner. The carrier assembly may be formed with a mirror image construction on the opposite side thereof to create a double sided carrier.

22 Claims, 2 Drawing Sheets

FIG. 1
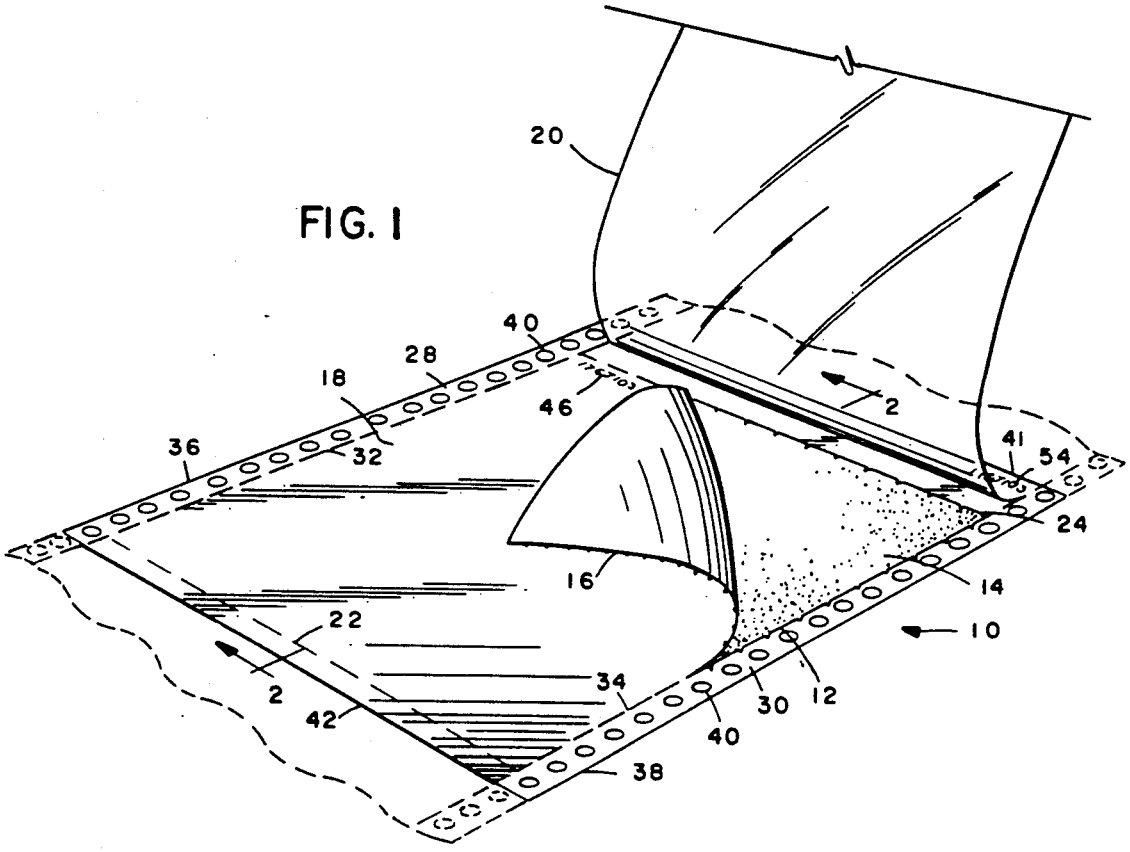
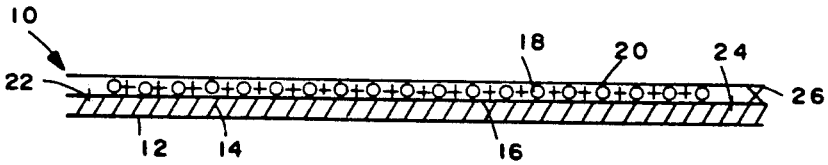
FIG. 2
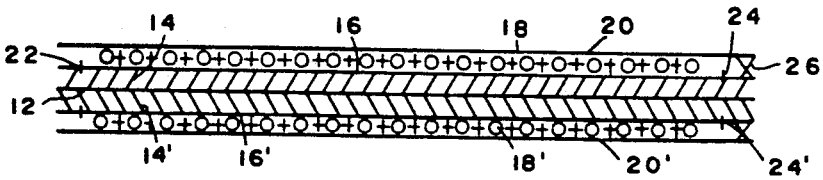
FIG. 3

DOCUMENT CARRIER

BACKGROUND AND SUMMARY OF THE INVENTION

This invention relates generally to a carrier form which is designed to permit a number of smaller documents to be processed simultaneously through micrographics equipment to produce a microfiche film of the documents.

Carrier assemblies for displaying and/or storing smaller documents such as microfiche film, are well known. For example, see U.S. Pat. No. 4,156,978; Canadian Patent No. 1,177,355; and French Patent No. 2,229,082.

Other carrier constructions are known wherein documents, such as photographs, are adhesively secured to a substrate and covered by a transparent cover film or sheet. Examples of such carrier constructions may be found in U.S. Pat. Nos. 4,077,830 3,857,192; 3,736,685; 3,581,423 and 3,283,434.

The present invention provides a unique carrier construction wherein a number of smaller documents to be microfilmed may be adhesively mounted on a substrate and protected by a transparent cover sheet or film. In the carrier construction in accordance with this invention, a protective, removable liner sheet is interposed between the adhesive substrate and the transparent cover sheet. This removable liner sheet is preferably pre-printed and thereafter may be used as a record sheet upon its removal from the substrate as described further herein.

Accordingly, in one exemplary embodiment of the invention, a carrier construction is provided which includes a base sheet or substrate covered over the entirety of one side thereof with a low tack adhesive. A paper liner sheet is mounted over the adhesive side of the substrate, with a transverse slit provided near one end to permit the liner to be peeled from the substrate when ready for use. A transparent film or cover sheet is secured at this same end of the construction so that the transparent cover sheet can be rolled back away from the liner to permit removal of the latter. Documents to be microfilmed then can be mounted on the adhesive base sheet, and the transparent cover sheet returned to its original position overlying the documents thereon and pressed into adhesive engagement with the exposed areas of the base sheet.

In a preferred arrangement, the upper surface of the liner is provided with a known CB/CF coating to provide the liner with a carbonless image transfer system, also known as a "self-contained" system. Such carbonless transfer systems are well known, and reference is made in this regard to U.S. Pat. Nos. 2,712,507; 3,016,308; and 4,199,174. The typical arrangement in carbonless transfer systems includes the use of three sheets with the top sheet having its back surface coated (CB) with an encapsulated solution of a colorless colorformer in a suitable solvent; the bottom sheet having its front surface (CF) coated with a solid material containing record-developing material; and the intermediate sheet being coated front and back (CFB), respectively, with the solid record developing material and with the color precursor. The back coatings (CB) normally comprise pressure rupturable microcapsules containing a color precursor in fluid form capable of reacting with the developing material to form a colored compound in the front coating of the next adjacent sheet so that, upon impact by a machine key or application of pressure by a stylus on the top sheet, a colored mark corresponding to the key or stylus will appear on the front surface of the next adjacent sheet.

In this case, it will be appreciated that separate CF and CB layers, or a single layer of mixed CF and CB coatings can be applied to the top surface of the liner to achieve essentially the same effect.

This arrangement permits the assembly to be passed through an impact-type printer so that variable information relating to, e.g., the documents to be placed thereon, can be applied to the liner sheet through the transparent cover sheet before removal of the liner from the assembly. After removal, the liner sheet can then serve as a record copy of the documents microfilmed on the associated substrate.

In an alternative exemplary embodiment, a double-sided document carrier is provided wherein the other or second side of the base or substrate is also provided with low tack adhesive, self-contained liner and transparent cover sheet as on the first side.

It is another feature of the present invention that the document carrier can be produced in continuous form, in the manner of a continuous business form assembly, with marginal feed strips along opposite side edges, and longitudinally spaced transverse lines of perforations defining individual carrier assemblies.

Accordingly, in one exemplary embodiment, the invention in its broader aspects relates to a document carrier assembly which comprises a web of paper having an upper and lower surface, at least the upper surface having a low tack adhesive layer applied thereon; a liner overlying the upper surface of the web and the low tack adhesive layer, the liner having a self-contained carbonless coating on an upper surface thereof; and a clear plastic film overlying the liner.

The invention as described herein provides an easy-to-use document carrier which has many applications including principally to facilitate simultaneous microfilming of a plurality of documents with an accurate record maintained thereof.

Other objects and advantages of the subject invention will become apparent from the detailed description which follows.

BRIEF DESCRIPTION OF THE DRAWINGS

FIG. 1 is a perspective view of a first exemplary embodiment of a document carrier assembly in accordance with this invention;

FIG. 2 is a schematic side cross sectional view of the document carrier illustrated in FIG. 1 taken along the line 2—2 of FIG. 1;

FIG. 3 is a side cross sectional view of a second exemplary embodiment of the document carrier in accordance with the invention, viewed from the same perspective as FIG. 2.

DETAILED DESCRIPTION OF THE DRAWINGS

Figure 4:
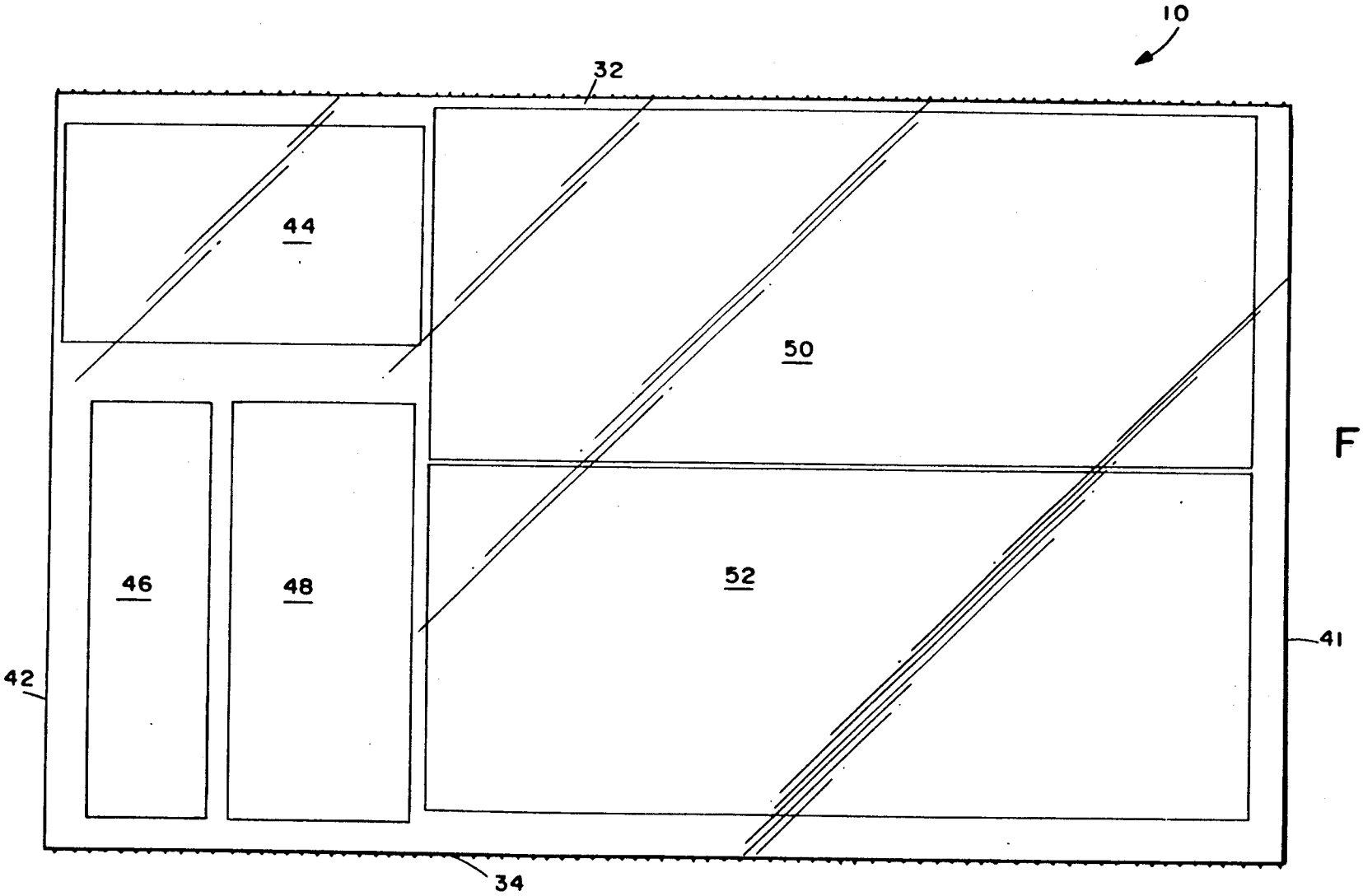
FIG. 4 is a top plan view of a document carrier in accordance with the invention, with documents to be microfilmed mounted thereon.

Referring now to FIGS. 1 and 2, the document carrier assembly 10 includes a base web 12, preferably a heavy-weight paper or the like coated over its entire upper surface (including marginal feed strips as described below) with a low tack adhesive 14. The low tack adhesive may be any of several known commercially available low tack adhesives including that known as NOTESTIX ® adhesive sold by Moore Business Forms Inc., the assignee of this invention.

A paper liner sheet 16 is mounted over the low tack adhesive 14 to protect the latter and to prevent undesirable adhesion between the base sheet and other material until ready for use. A transparent cover sheet or film 20 overlies the liner sheet and is secured at one end of the assembly as further described below.

The removable liner 16 is provided in the form of a "self-contained" web. This is a well known carbonless image transfer system wherein a surface of the liner (in this case the upper surface) has a CF/CB coating 18 applied thereto so that the assembly can be passed through a computer printer or typewriter and have information applied to the liner through the transparent sheet. This enables information, for example relating to the documents to be microfilmed, instructions on how to use the carrier, etc. to be applied to the liner through the transparent cover sheet. As described further below, this also permits the liner sheet to serve as a record copy when removed from the carrier assembly.

The liner sheet 16 is further provided at both the upper and lower ends of the sheet, with transverse lines of perforations 22, 24, respectively, which permit and facilitate removal of the major portion of the liner sheet 16 as best seen in FIG. 1. At the same time, the upper edge of the transparent cover sheet or film 20 is secured to the liner by a permanent line of adhesive 26 so that the liner can be rolled or folded back away from the remainder of the carrier assembly in order to permit the liner sheet 16 to be removed.

It will be appreciated that the document carrier as described above may be manufactured in continuous web form as shown in FIG. 1. In this case, the base web 12 and liner sheet 16 are extended laterally to include marginal strips 28 and 30 which are defined, respectively between longitudinally extending perforation lines 32, 34 and longitudinal side edges 36, 38. Feed holes 40 may be provided within the marginal feed strips as is conventional in the business forms art. The transparent sheet 20 need not extend the full width of the form, and preferably terminates at the perforation lines 32, 34.

Individual document carriers within the continuously extending web are defined by transverse lines of perforations 41, 42, separating adjacent forms (shown in phantom). When manufactured in continuous form, the overlying transparent cover sheet 20 may be applied over the continuous webs in discrete lengths, with edges substantially aligned with transverse edges 41, 42, respectively. In this way, the transparent sheets need not be separated from adjacent sheets by tearing.

It will be appreciated that the continuous web may be printed and folded in zig-zag fashion and shipped to the customer, or the customer may print the carriers upon receipt.

With reference to FIG. 3, a double sided document carrier is illustrated wherein adhesive 14', liner sheet 16', self-contained coating 18', and transparent film or cover sheet 20', are secured to the lower surface of the base 12 to thereby provide a mirror image of the construction on the upper side of the base.

In use, after removal of the marginal feed strips 28, 30 (if desired), the transparent film or cover sheet is rolled back from bottom to top but without detachment from the assembly. Thereafter, the major intermediate portion of the liner is peeled back from either the upper right or left hand corner to expose the low tack adhesive on the base sheet. Documents to be microfilmed, such as receipts, invoices, etc. shown at 44, 46, 48, 50 and 52 are then placed on the exposed low tack adhesive of the base sheet. The clear film cover sheet is then rolled back down over the documents and exposed adhesive and pressed into place. The previously removed liner may then be used as a record copy of the documents to be microfilmed. In this regard, it will be appreciated that in order to facilitate the record keeping function, a serial or code number 54 may be applied to the upper edge of the carrier assembly, and an identical number 56 applied to the removable portion of the liner sheet in order that the separated documents can then be later traced by such serial or code numbers.

It will further be appreciated that the liner sheet can be pre-printed with instructions on how to use the form or other data in addition to or as an alternative to the variable information which may be applied in conjunction with the documents to be microfilmed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A document carrier assembly for processing a plurality of documents through a microfilming machine comprising;

a web of paper having an upper and lower surface, at least said upper surface having a low tack adhesive layer applied thereon;

a liner overlying said upper surface of the web and said low tack adhesive layer so as to releasably secure said liner to said web, said liner having a self-contained carbonless coating on an upper surface thereof;

a clear plastic film overlying said liner; and means for adhering said clear plastic film to said liner.

2. The document carrier assembly according to claim 1 wherein said means for adhering said clear plastic film to said liner comprises adhesive extending along aligned edges of said film and said liner.

3. The document carrier assembly according to claim 1 wherein said aligned edges lie transverse to a pair of longitudinally extending side edges.

4. The document carrier assembly according to claim 2 wherein said liner includes a slit line adjacent and parallel to said one edge, thereby defining a marginal edge portion and enabling removal of said liner from said carrier.

5. The document carrier assembly according to claim 1 wherein identifying data are provided on the carrier and on the said liner.

6. The document carrier assembly according to claim 1 wherein said liner is provided with transverse slit lines adjacent upper and lower edges thereof to thereby facilitate removal of a major portion thereof intermediate said slit lines.

7. The document carrier assembly according to claim 1 wherein a second low tack adhesive coating is applied to said lower surface of said web.

8. The document carrier assembly according to claim 7 wherein a second removable liner overlies said second low tack adhesive and a second clear plastic film overlies said second liner to thereby form a double-sided document carrier

9. The document carrier assembly according to claim 1 and wherein said carrier assembly is incorporated within a continuous line of identical carrier assemblies, each of which being defined by a pair of longitudinally spaced, transversely extending lines of perforations

10. The document carrier assembly according to claim 9 and wherein each assembly includes marginal feed strips extending along opposite elongated edges thereof.

11. The document carrier assembly according to claim 10 wherein said clear plastic film extends laterally only to said marginal feed strips.

12. A continuous web incorporating a plurality of document carrier assemblies and including longitudinally spaced transverse lines of perforations defining individual carrier assemblies therebetween, each carrier assembly comprising:

a web of paper having an upper and lower surface, at least said upper surface having a low tack adhesive layer applied thereon;

a removable liner overlying said upper surface of the web and said low tack adhesive layer, said liner having a self-contained carbonless coating on an upper surface thereof; and a clear plastic film overlying said liner, and secured to said assembly along one transverse edge thereof.

13. The document carrier assembly according to claim 12 wherein said clear plastic film is adhered to said liner along a forward edge thereof.

14. The document carrier assembly according to claim 12 wherein said clear plastic film is discontinuous along said continuous web.

15. The document carrier assembly according to claim 13 wherein said liner includes at least one slit line defining a transverse marginal edge portion enabling removal of said liner from said web.

16. The document carrier assembly according to claim 12 wherein identifying data are provided on the carrier and on said removable liner.

17. The document carrier assembly according to claim 12 wherein said clear plastic film is adhered to said liner along said one transverse edge.

18. The document carrier assembly according to claim 12 wherein said liner is provided with transverse slit lines adjacent upper and lower edges thereof to thereby facilitate removal of a major portion thereof intermediate said slit lines.

19. The document carrier assembly according to claim 12 wherein a second low tack adhesive coating is applied to said lower surface of said web.

20. The document carrier assembly according to claim 19 wherein a second removable liner overlies said second low tack adhesive coating and a second clear plastic film overlies said second removable liner to thereby form a double-sided document carrier.

21. The document carrier assembly according to claim 20 and further including marginal feed strips extending longitudinally along opposite side edges of said assembly.

22. The document carrier assembly according to claim 21 wherein said clear plastic film extends laterally only to said marginal feed strips.

* * * * *